US007975431B2

(12) United States Patent
Flannery

(10) Patent No.: US 7,975,431 B2
(45) Date of Patent: Jul. 12, 2011

(54) MULTIPLE PIECE GATED PRESSURIZED BARRIER

(75) Inventor: Mark A Flannery, Longboat Key, FL (US)

(73) Assignee: Carlson Pet Products, Inc., Longboat Key, FL (US)

( * ) Notice: Subject to any disclaimer, the term of this patent is extended or adjusted under 35 U.S.C. 154(b) by 290 days.

(21) Appl. No.: 12/156,373

(22) Filed: May 31, 2008

(65) Prior Publication Data

US 2009/0293363 A1 Dec. 3, 2009

(51) Int. Cl.
*E06B 7/00* (2006.01)

(52) U.S. Cl. ..... 49/57; 49/55; 49/463; 49/465

(58) Field of Classification Search ..... 49/50, 55, 49/57, 463, 465; 160/215
See application file for complete search history.

(56) References Cited

U.S. PATENT DOCUMENTS

| | | | | |
|---|---|---|---|---|
| 4,583,715 | A * | 4/1986 | Wright | 256/24 |
| 4,611,431 | A * | 9/1986 | Lauro | 49/55 |
| 4,628,635 | A * | 12/1986 | Maillard | 49/55 |
| 4,685,247 | A * | 8/1987 | Alam | 49/55 |
| 5,117,585 | A * | 6/1992 | Andrisin, III | 49/55 |
| 5,809,694 | A * | 9/1998 | Postans | 49/57 |
| 6,056,038 | A * | 5/2000 | Foster et al. | 160/351 |
| 6,176,042 | B1 * | 1/2001 | Rossman et al. | 49/463 |
| 6,253,490 | B1 * | 7/2001 | Postans | 49/55 |
| 6,499,254 | B2 * | 12/2002 | Rossman et al. | 49/55 |
| 6,655,087 | B2 * | 12/2003 | Andersen | 49/55 |
| 7,152,372 | B2 * | 12/2006 | Cheng | 49/465 |
| 7,334,624 | B2 * | 2/2008 | Waldman et al. | 160/144 |
| 7,373,755 | B2 * | 5/2008 | Jefferys et al. | 49/55 |
| 7,540,046 | B1 * | 6/2009 | Lai | 5/100 |
| 2001/0000556 | A1 * | 5/2001 | Rossman et al. | 49/463 |
| 2002/0157316 | A1 * | 10/2002 | Andersen | 49/55 |
| 2003/0009945 | A1 * | 1/2003 | Cheng | 49/57 |
| 2003/0110704 | A1 * | 6/2003 | Cheng | 49/463 |
| 2004/0045222 | A1 * | 3/2004 | Hicks | 49/394 |
| 2005/0028947 | A1 * | 2/2005 | Waldman et al. | 160/215 |
| 2006/0207180 | A1 * | 9/2006 | Cheng | 49/57 |
| 2007/0074453 | A1 * | 4/2007 | Flannery | 49/57 |

FOREIGN PATENT DOCUMENTS

| | | | |
|---|---|---|---|
| GB | 2193992 A | * | 2/1988 |
| GB | 2234281 A | * | 1/1991 |

* cited by examiner

*Primary Examiner* — Jerry Redman

(57) ABSTRACT

A barrier that is pressurized after being assembled from multiple pieces. The barrier include a first end frame, a second end frame, and a gate engaged between the end frames. The first and second end frames are engaged at their lower members such that the first end frame and second end frame are not integral and not one-piece with each other, and such that the first and second end frames still provide for a pressurized barrier, that is a barrier that is resiliently mounted between two locations so as to be self-supporting between two locations even if spaced from the floor. In a preferred embodiment of the invention, the first end frame, second end frame, and gate have generally the same length so as to minimize the storage area needed to store the barrier prior to assembly.

10 Claims, 4 Drawing Sheets

MULTIPLE PIECE GATED PRESSURIZED BARRIER

FIELD OF THE INVENTION

The present invention generally relates to a gated barrier for the inside of a home, more particularly to a pressurized gated barrier, and more specifically to a pressurized gated barrier that is not integral and not one-piece.

BACKGROUND OF THE INVENTION

A pressurized gate apparatus for the inside of a home is engaged between two locations, such as between two door jambs of a doorway. With the internal pressure of the pressurized gate apparatus, the apparatus can support itself off the floor and the swinging gate can be handled relatively roughly as it is opened and closed throughout the day.

SUMMARY OF THE INVENTION

A feature of the present invention is the provision in a gated pressurized barrier, of the frame surrounding the gate of the pressurized barrier being assembled from multiple pieces.

Another feature of the present invention is the provision in a gated pressurized barrier, of the frame surrounding the gate of the pressurized barrier being assembled with pins from more than one piece.

Another feature of the present invention is the provision in a gated pressurized barrier, of the frame surrounding the gate of the pressurized barrier not being integral and not being one-piece.

Another feature of the present invention is the provision in a gated pressurized barrier, of the frame surrounding the gate of the pressurized barrier having a two-piece lower member, and of the two pieces being engagable and disengagable to and from each other.

Another feature of the present invention is the provision in a gated pressurized barrier, of a pressurized configuration and a nonpressurized configuration, of the barrier having a pair of gate confronting standards, where in the pressurized configuration upper ends of the gate confronting standards are set apart at a first distance and lower ends of the gate confronting standards are set apart at a second distance, where in the nonpressurized configuration the upper ends of the gate confronting standards are set apart at a third distance and the lower ends of the gate confronting standards are set apart at substantially the second distance, and where the first distance is less than the third distance.

Another feature of the present invention is the provision in a gated pressurized barrier, of the barrier having first and second end frames, of the first and second end frames having lower members, and of the lower members being engagable to and disengagable from the barrier while maintaining the structural integrity of said barrier.

Another feature of the present invention is the provision in a gated pressurized barrier, of the lower members of the first and second end frames being directly engagable to each other.

Another feature of the present invention is the provision in a gated pressurized barrier, of the barrier having a gate confronting tie, and of the lower members of the first and second end frames being engaged to each other via the gate confronting tie.

Another feature of the present invention is the provision in a gated pressurized barrier, of one of the lower members including an inverted U-shaped elongate piece that is engaged to the barrier, and of the inverted U-shaped elongate piece being elongate in the length direction.

Another feature of the present invention is the provision in a gated pressurized barrier, of each of the lower members of the first and second end frames having an inner ends, and of one of the inner ends being set in the other of the inner ends.

Another feature of the present invention is the provision in a gated pressurized barrier, of the lower members of the first and second end frames being engagable and disengagable from the barrier by pins.

Another feature of the present invention is the provision in a gated pressurized barrier, of the first end frame having two endmost portions, with each of said endmost portions defining a point on a respective parallel axis, with a distance between said parallel axes being a fourth distance, and where the first end frame is wholly contained within such parallel axes; of the second end frame having two endmost portions, with each of said endmost portions defining a point on a respective parallel axis, with a distance between said parallel axes being substantially said same fourth distance, and where the second end frame is wholly contained within such parallel axes; and of the gate having two endmost portions, with each of said endmost portions defining a point on a respective parallel axis, with a distance between said parallel axes being substantially said same fourth distance, and where the gate is wholly contained within such parallel axes; such that a storage size of the gated pressurized barrier is minimized.

Another feature of the present invention is the provision in a gated pressurized barrier, of a lock pin between the gate and the end frame to which the gate pivots, of the pin having a shaft and a spring biased button slideable into and out of the shaft on an axis perpendicular to the axis of the shaft, with one of the gate and said end frame having a first opening for said shaft and a second opening for said button, with said second opening including two ends, with one said end being open to receive said button and with the other said end being closed to maximize difficulty in depressing said button and thereby maximize difficulty in removing said pin and disassembling said gated pressurized barrier.

Another feature of the present invention is the provision in a gated pressurized barrier, of each of the first and second end frames having a gate confronting standard extending in the height direction and an end member extending in the height direction such that said gate confronting standard and end members extend to and between upper and lower members of the end frames, of each of the gate confronting standard and end member having a length, and of the length of the gate confronting standard being greater that the length of the end member such that the barrier may withstand a relatively great amount of internal pressure while minimizing a weight of the barrier.

Another feature of the present invention is the provision in a gated pressurized barrier, of the gate confronting standard of the first end frame being integral and one-piece with the lower member of the first end frame and of the gate confronting standard of the second end frame being integral and one-piece with the lower member of the second end frame.

An advantage of the present invention is size. The present gated pressurized barrier has a relatively small size when in a stored configuration and a relatively great size when in an operating configuration.

Another advantage of the present invention is pressure. The present gated pressurized barrier can withstand a great amount of internal pressure and, at the same time, have gate confronting standards that are not integral with each other and that are not one-piece with each other.

Another advantage of the present invention is weight. The present gated pressurized barrier is relatively lightweight and, at the same time, is strong and can withstand a great amount of internal pressure.

Another advantage of the present invention is cost. The present gated pressurized barrier is inexpensive to manufacture. For example, the barrier has relatively few parts.

Another advantage of the present invention is simplicity. The present gated pressurized barrier is simple to assemble and simple to operate.

Another advantage of the present invention is safety. The present gated pressurized barrier is slowly pressurized and slowly depressurized via a set of turnable arms.

DETAILED DESCRIPTION

Figure 1A:
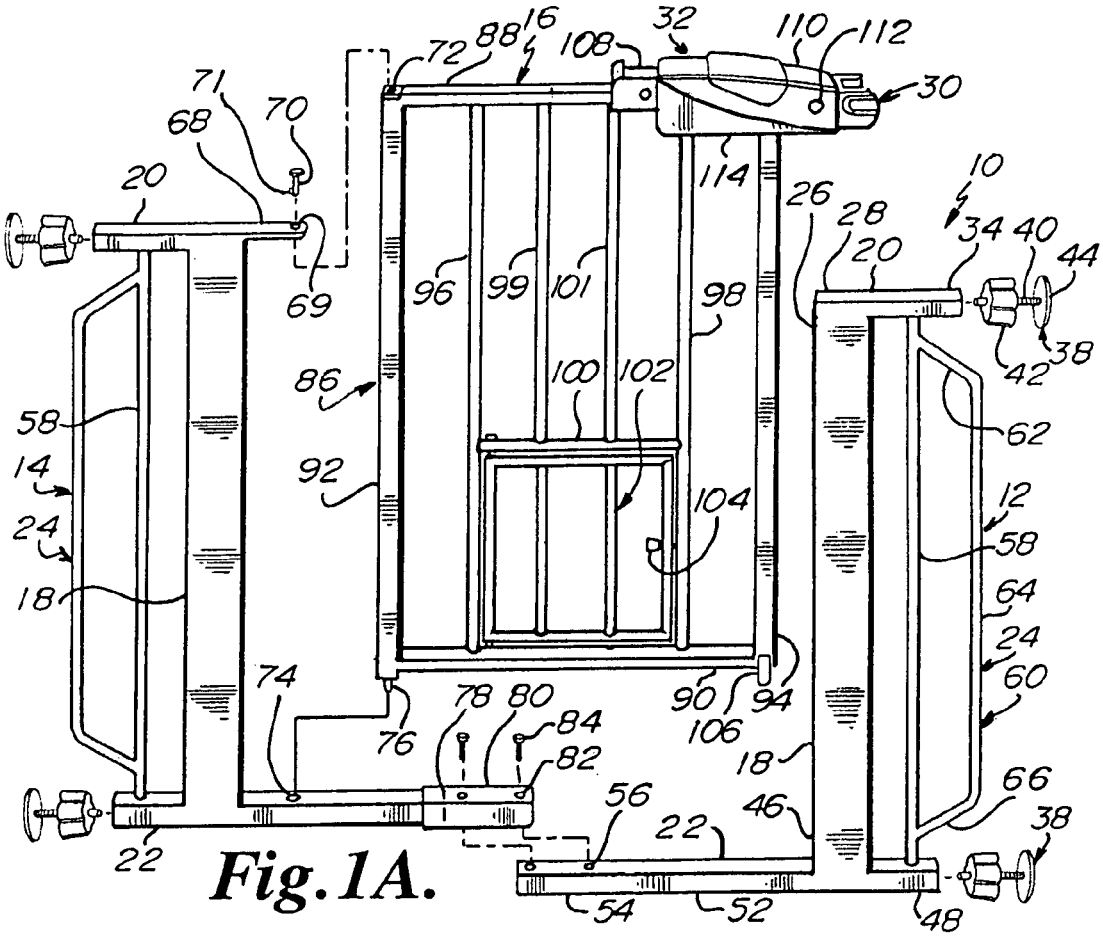
FIG. 1A is an exploded front slightly perspective view of the preferred embodiment of the present multiple piece gated pressurized barrier where lower members directly engage each other.
Figure 1B:
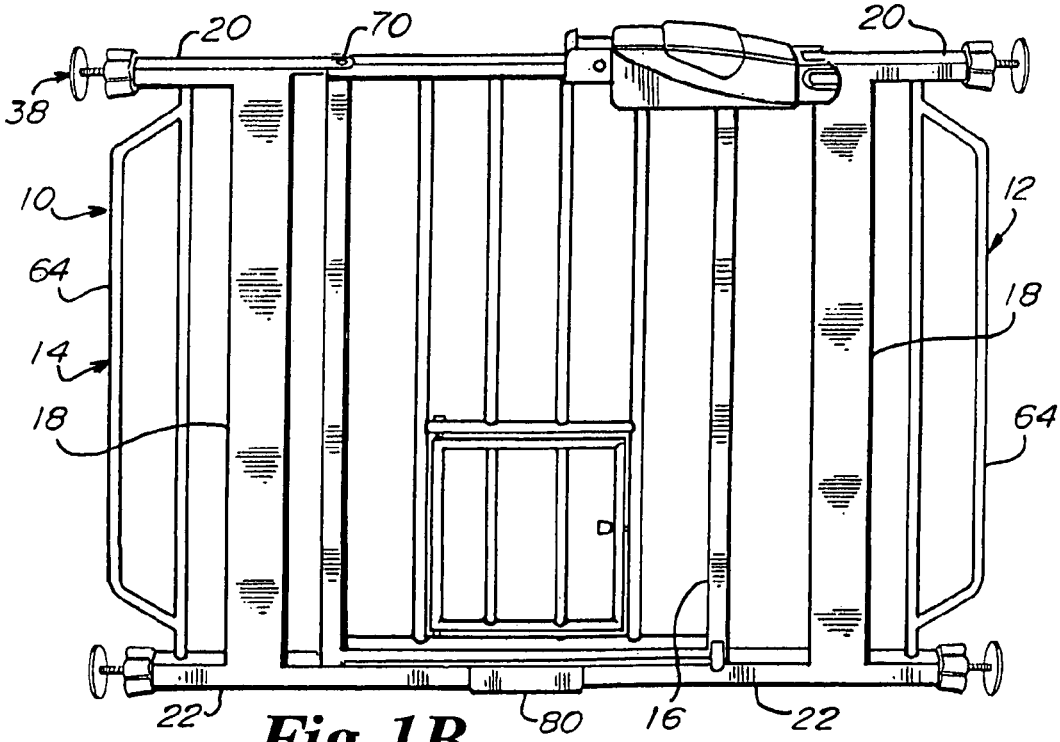
FIG. 1B is a front slightly perspective view of the embodiment of FIG. 1A where the multiple pieces of the barrier have been assembled.

As shown in FIG. 1A, the preferred embodiment of the present multiple piece gated pressurized barrier is indicated in general by the reference numeral 10. Barrier 10 generally includes a first end frame 12, a second end frame 14, and a gate 16 engagable between the end frames 12, 14. Barrier 10 includes a height direction, a length direction defined, for example, by the direction between two door jambs between which the barrier 10 is engaged, and a width or thickness direction. The height, length and width (or thickness) directions extend perpendicular to each other.

First end frame 12 includes a gate confronting standard 18, an upper member 20, a lower member 22, and an end member 24. Standard or upright member 18 confronts the gate 16, is elongate in the height direction, and extends between the upper and lower members 22 with which standard 18 is integral and one-piece. Such an integral and one-piece connection is formed, for example, by welding. Standard 18 is tubular, may be formed of a metal such as steel or aluminum, and is generally rectangular in section. Standard 18 includes an axis extending in the height direction, gate confronting portion 52 of lower member 22 includes an axis extending inwardly from standard 18 in the length direction, and such two axes are oblique relative to each other. In other words, such two axes are slightly greater than ninety degrees, with a range of such two axes being between 90.5 and 100 degrees, more preferably between 90.5 and 95 degrees. An upper end portion 26 and/or an inner end portion 28 of upper member 20 can receive a catch 30 of a latch 32 of the gate 16.

Upper member 20 is elongate in the length direction and extends outwardly from the upper end portion 26 of the standard 18. Upper member 20 is tubular, may be formed of a metal such as steel or aluminum, and is generally square in section. Upper member 20 includes an outer end 34 that includes an opening 36, shown in FIG. 2, for slidingly receiving a pressurizing turnable arm 38. Arm 38 includes a threaded shaft 40 that engages opening 36 in a sliding fashion. Spinnable on the threaded shaft 40 is a hand or finger knob or hand wheel 42 that is threaded and engages the threads of the shaft 40. Fixed to the end of the threaded shaft 40 is a disk 44 for making contact with and bringing pressure to bear upon a location or surface such as a door jamb. In use, the inner end of hand or finger knob 42 makes contact with the end 34 and, as the knob 42 is rotated into the end 34, such rotation draws the threaded shaft 40 in the outward direction and draws the disk 44 outwardly to apply pressure against the door jamb. If desired, disk 44 may be set in a cup or receptacle, having a recess about the size of the disk 44, where such cup or receptacle is screwed to the door jamb. Such cup or receptacle minimizes transverse or up or down movement of the disk 44 relative to the door jamb.

Lower member 22 is elongate in the length direction, runs generally parallel to the upper member 20, and extends inwardly and outwardly relative to a lower end portion 46 of standard 18. Lower member 22 is tubular, may be formed of a metal such as steel or aluminum, and is generally rectangular in section. The dimensions of the rectangular section of lower member 22 may be identical with the dimensions of the rectangular section of standard 18. In other words, the height and width of the rectangular section of lower member 22 may be identical to the length and width of the rectangular section of standard 18. Lower member 22 includes an outer end portion or end 48 having an opening 50, shown in FIG. 2. Opening 50 extends inwardly along an upper edge of upper member 20 and extends in the length direction. Opening 50 slidingly receives another turnable arm 38. Lower member 22 includes gate confronting inwardly extending portion 52 having an inner end portion 54. Inner end portion 54 includes a pair of threaded openings 56, opening downwardly from an upper face of the lower member 22.

End member 24 of first end frame 12 includes a tubular post or upright member 58 engaged to and between upper member 20 and the outer end portion 48 of lower member 22. Post 58 is integral and one-piece with upper member 20 and outer end portion 48. Tubular post 58 is tubular, may be formed of a metal such as steel or aluminum, and is circular in section. Extending outwardly off the tubular post 58 is a C-shaped upright member 60 having a downwardly and outwardly oblique member portion 62, a medial upright member portion 64, and an upwardly and outwardly oblique member portion 66. C-shaped member 62 is integral and one-piece with post 58. Member portions 62 and 66 engages post 58 at junctions terminating short of the upper member 20 and lower member 22, respectively. C-shaped upright member 60 is a cylindrical member and is preferably formed of a metal such as aluminum or steel. Each of standard 18, post 58, and member portion 64 includes an axis, and such axes are equidistant from each other. Standard 18 has a greater length than either the length of post 58 or the length of post 64 (where the length direction is defined as the direction between the two locations between which the barrier 10 is engaged) because, for example, standard 18 along with lower member 22 provides the pressure for engagement between the two locations. First end frame 12 as a whole, including standard 18, upper member 20, lower member 22, post 58, and C-shaped section 62, are integral and one-piece with each other and are set in a common plane.

Second end frame 14 is identical to first end frame 12 with the following exceptions:

1) A first exception is that second end frame 14 includes, and first end frame 12 does not include, an inwardly extending elongate relatively narrow plate mount 68 for the gate 16. Mount 68 includes a distal end having an opening 69 for a pivot lock pin 70 that engages an opening 72 in gate 16. Mount 68 is preferably formed of a metal such as steel or aluminum. Mount 68 is rigidly affixed, such as by welding, to the upper member 20 of second end frame 14 and extends in the same common plane as second end frame 14. Pin 70 is engaged between the gate 16 and the end frame 14 to which the gate 16 pivots. Pin 70 is on the axis on which the gate 16 pivots. Pin 70 includes a shaft that has an axis coaxial with the axis on which gate 16 pivots. Pin 70 includes a spring biased button 71 slideable into and out of the shaft on an axis perpendicular to the axis of the shaft. Spring biased button 71 is normally biased outwardly. The gate 16, namely member 92, includes a first opening 72 for the shaft and a second opening for the button 71. The second opening is recessed in member 92 and is spaced from first opening 72. The second opening includes two ends, with one of the ends being open to receive button 71 and with the other of the ends being closed to maximize difficulty in depressing the button 71 and thereby maximize difficulty in removing lock pin 70 and disassembling the gated pressurized barrier 10.

2) A second exception is that second end frame 14 includes, and first end frame 12 does not include, an opening 74 extending downwardly from an upper face of lower member 22 of second end frame 14. Opening 74 receives a pin 76 rigidly affixed to gate 16. Opening 69, pin 70, opening 72, opening 74 and pin 76 are coaxial with each other when the barrier 10 is assembled.

3) A third exception is that gate confronting portion 52 is foreshortened such that, on second end frame 14, gate confronting portion 52 includes a terminal end 78 as shown in phantom.

4) A fourth exception is that gate confronting portion 52 of lower member 22 of second end frame 14 includes an inverted U-shaped channel piece 80. Piece 80 is rigidly affixed, such as by welding, to an end portion of gate confronting portion 52 such that piece 80 is integral and one-piece with lower member 22 of the second end frame 14. Piece 80 is preferably formed of a metal such as steel or aluminum and is elongate in the length direction. Piece 80 includes a pair of holes 82 formed in the upper plate section of piece 80. Holes 82 align with holes 56 when the lower members 22 are engaged to each other via the piece 80. Holes 56 preferably include threaded inserts to receive threaded pins 84, preferably screws. Holes 82 are preferably not threaded and the heads of the pins 84 engage the material, preferably metal, about the openings 82. Side plate sections of piece 80 are spaced apart in the width direction so as to snugly receive and frictionally fit inner end portion 54 of lower member 22 of end frame 12. An absolute end of inner end portion 54 of end frame 12 confronts and abuts the terminal end 78 of gate confronting portion 52 of second end frame 14 when the inner end portion 54 has been fully received and engaged in piece 80 and when holes 82 are aligned with holes 56.

5) A fifth exception is that there is substantially a right angle between the axis of standard 18 and the axis of gate confronting portion 52 of second end frame 14. While an angle of slightly more than ninety degrees can be provided here, such is not required. The angle of slightly more than ninety degrees, as found between the standard 18 and gate confronting portion 52 of the first end frame 12, contributes to the resilient structure for pressurizing the barrier 10 as a whole.

Gate 16 includes a frame 86. Frame 86 is preferably formed of a metal such as steel or aluminum. Frame 86 includes an upper member 88, lower member 90, end member 92 and end member 94. Upper members 88, 90 are engaged to and between the end members 92, 94. Members 88, 90, 92, 94 are tubular and square in section. End member 92 includes the axis on which gate 16 swings. End member 92 depends slightly below and beyond lower member 90 such that lower member 90 and gate 16 as a whole is spaced slightly above the lower members 22 of end frames 12, 14, including U-shaped piece 80. Pin 76 depends from the lower end of end member 92. Gate 16 rides on the lower end of end member 92. Frame 86 further includes a pair of tubular cylindrical posts 96, 98 engaged to and between upper and lower members 88, 90. Frame 86 further includes a tubular cylindrical member 100 running in the length direction and engaged between posts 96, 98. Frame 86 further includes upright members or tubular cylindrical posts 99, 101 running to and between member 100 and upper member 88. Frame 86 further includes a hinged pet door 102 hingedly engaged between member 100 and member 90 and extending between posts 96 and 98. Pet door 102 includes four spaced apart upright posts extending between an upper member and a lower member. Pet door 102 further includes a spring biased latch 104 engaging post 98. Pet door 102 can swing out of either of the faces of the gate 16. Frame 86 further includes a stop 106 that prevents the gate 16 from swinging through the barrier 10. Instead, gate 16, because of the stop 106, swings only out of one face of the barrier 10. Stop 106 confronts and makes contact with the outer side of gate confronting portion 52 of end frame 12 when the gate 16 is closed.

Gate 16 further includes latch 32. Latch 32 includes a sliding lock 108 that locks down a pivoting lever handle 110 that swings on a pivot 112 engaged to a latch body 114. When the lock 108 is slid back, the handle 110 may be swung up so as to draw the catch 30 in and disengage the catch 30 relative to the upper end portion 26 or upper member 20 such that the gate 16 may be opened.

Figure 2:
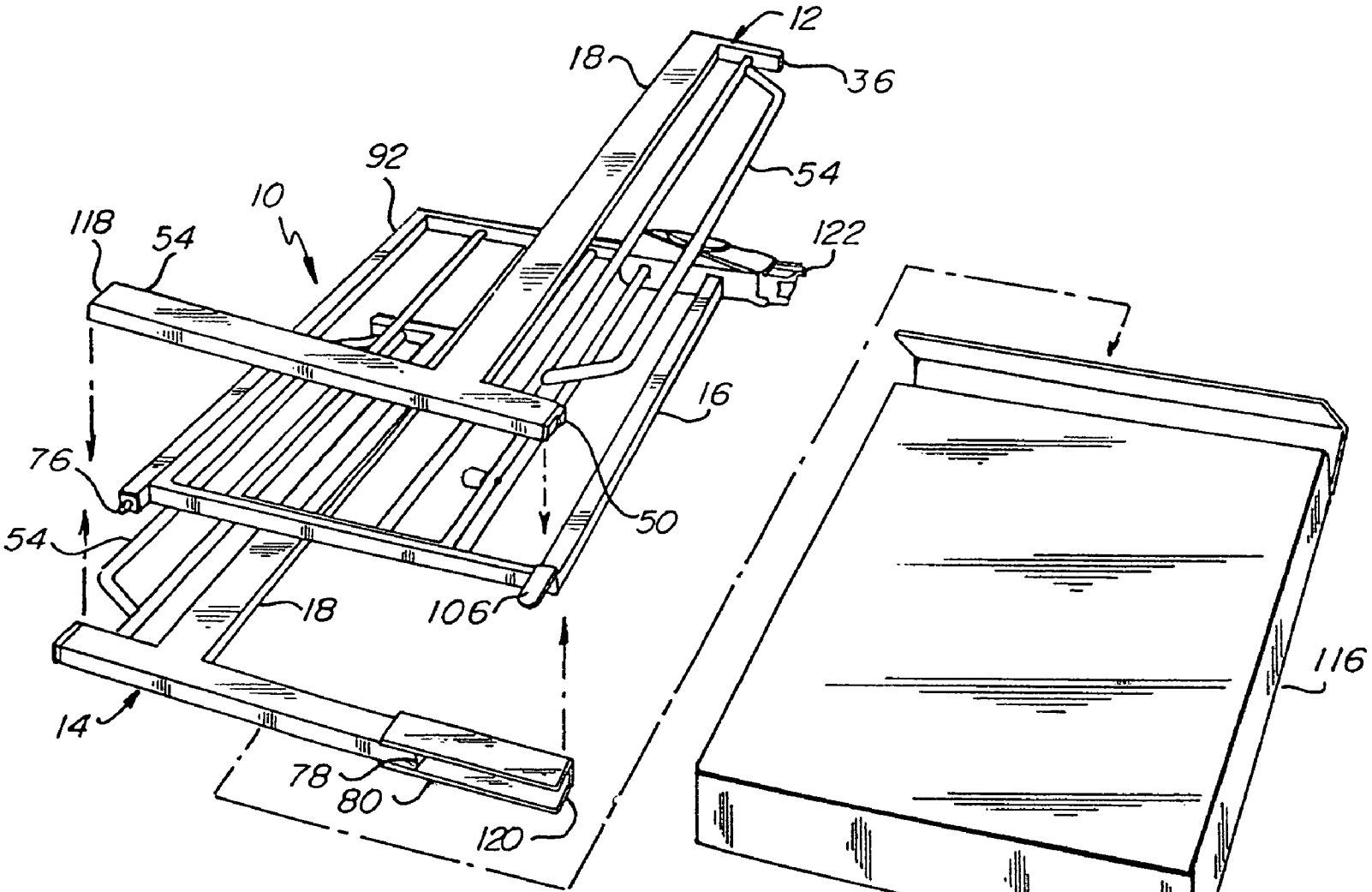
FIG. 2 is a disassembled perspective view of the embodiment of FIGS. 1A and 1B and a carton for receiving and shipping or storing the disassembled embodiment therein.

As shown in FIG. 2, barrier 10 can be stored or shipped in a box 116 of minimum size. One feature that provides for this advantage is the engagement and disengagement of the lower members 22 via the U-shaped piece 80. Another feature that provides for this advantage is that the first end frame 12, the second end frame 14 and the gate 16 have lengths that are substantially the same. In other words, the first end frame 12 has two endmost portions, namely medial member portion 64 and the absolute inner end 118 of inner end portion 54, where each of portion 64 and end 118 includes a point on a respective parallel axis, where a distance between such parallel axes is a fourth distance, and where first end frame 12 is wholly contained within such parallel axes. The second end frame 14 has two endmost portions, namely medial member portion 64 and an absolute end 120 of U-shaped piece 80, where each of portion 64 and end 120 includes a point on a respective parallel axis, where a distance between such parallel axes being substantially the fourth distance, and where second end frame 14 is wholly contained within such parallel axes. The gate 16 has two endmost portions, namely an absolute end 122 of catch 30 and end member 92, where each of end 122 and end member 92 includes a point on a respective parallel axis, where a distance between such parallel axes being substantially the fourth distance, and where gate 16 is wholly contained within such parallel axes. Therefore, since the length of first end frame 12, second end frame 14, and gate 16 is substantially the same as defined by the fourth distance, a storage size of the gated pressurized barrier 10 is minimized.

To assemble the barrier 10, the first end frame 12, the second end frame 14, and the gate 16 are removed from the box 116. First, gate 16 is engaged to second end frame 14. Specifically, pin 76 is engaged in hole 74 and pin 70 is engaged in openings 69 and 72 such that button 71 locks pin 70 into member 92. Then the first end frame 12 and second end frame 14 are engaged to each other by sliding the inner end portion 54 into the U-shaped piece 80 and screwing in the pins 84. In the assembled configuration, prior to be placed in an operating and pressurized configuration, barrier 10 is in a nonpressurized configuration.

Then, to engage the barrier 10 between two locations such as between two door jambs, the shafts 40 of the upper turnable arms 36 are slid into ends 34 of the first and second end frames 12, 14 and the shafts 40 of the lower turnable arms 36 are slid into outer end portions 48 of the first and second end frames 12, 14. Then the barrier 10 is placed between such two locations and the knobs or hand wheels 42 are spun against ends 34 and 48 so as to draw the disks 44 outwardly. As the disks 44 are drawn outwardly, the disks 44 bring pressure to bear on the two spaced apart locations such as door jambs. In turn, the standards 18 begin to resiliently swing from an oblique relationship with gate confronting portions 52 toward a right angle relationship with gate confronting portions 52. In other words, the upper end portions 26 of the standards 18 are resiliently drawn or resiliently pushed relatively toward each other as the upper disks 44 are drawn outwardly and, at the same time, the standards 18 move from a nonparallel relationship with each other toward or to a parallel relationship with each other. As the disks 44 continue to be drawn outwardly, catch 30 engages upper end portion 26 or inner end portion 28. When catch 30 is so engaged, the gate 16 and the barrier 10 as a whole is in an operating configuration or a pressurized configuration. When lower disks 44 are drawn outwardly, such an action fixes a lower portion of the barrier 10 between the two locations and compresses the lower members 22 only to a slight degree.

It should be noted that the gated pressurized barrier 10 includes a pressurized configuration and a nonpressurized configuration. In the pressurized configuration the upper ends of the gate confronting standards 18 are set apart at a first distance and the lower ends of the gate confronting standards 18 are set apart at a second distance. In the nonpressurized configuration the upper ends of the gate confronting standards 18 are set apart at a third distance and the lower ends of the gate confronting standards 18 are set apart at substantially the second distance, and where the first distance is less than the third distance. Lower members 22 are disposed on a common axis in the nonpressurized configuration. Lower members 22 may be slightly bowed downwardly in the pressurized configuration. When bowed, lower members 22 remain in a common plane with the barrier 10 as a whole. Since there is a slight bowed structure to the lower members 22, namely the gate confronting portion 52 and inner end portion 54, the second distance in the pressurized configuration is slightly less than the second distance in the nonpressurized configuration; however, the second distances in each of the pressurized and nonpressurized configurations are still substantially the same, i.e. having a difference from each other not measurable with much precision with a tape measure, where the difference is preferably within one-eighth of inch, and more preferably within one-sixteenth of an inch. The first distance (the distance between upper ends in the pressurized configuration) is preferably between about one inch and about two inches shorter than the third distance (the distance between the upper ends in the nonpressurized configuration).

When in use, gate 16 may be operated so as to be swung open. Pet door 104 may be operated so as to swing open. Barrier 10 includes upright members, including members 64, 58 and 18 of first and second end frames 12, 14, and further including members 92, 96, 99, 101, 98, and 94, that are spaced sufficiently close together to prevent the passing through of small children and small dogs, and that are spaced sufficiently far apart to let hands pass through.

To remove the barrier 10 from between the two locations such as two door jambs, knobs or hand wheels 42 are turned outwardly so as to draw in and loosen the disk 44 relative to the door jamb and so as to relieve internal pressure within the barrier 10. When one or more of the standards 18 returns to its nonpressurized configuration, one or more knobs or hand wheels 42 are turned slightly more, and the barrier 10 loosens relative to the door jambs. Thereupon, the barrier 10 may be removed from between the two locations.

Figure 3A:
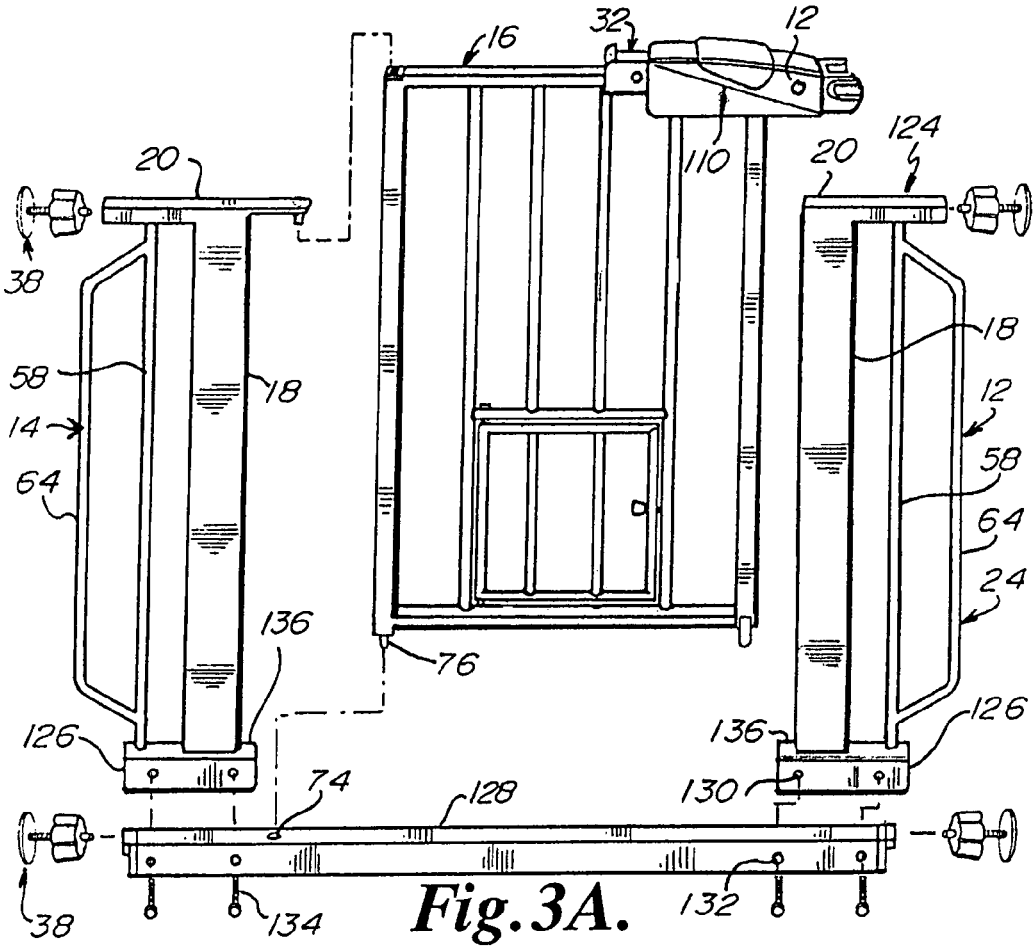
FIG. 3A is an exploded front slightly perspective view of an alternate embodiment of the present multiple piece gated pressurized barrier where lower members are engaged to each other via a gate confronting tie.
Figure 3B:
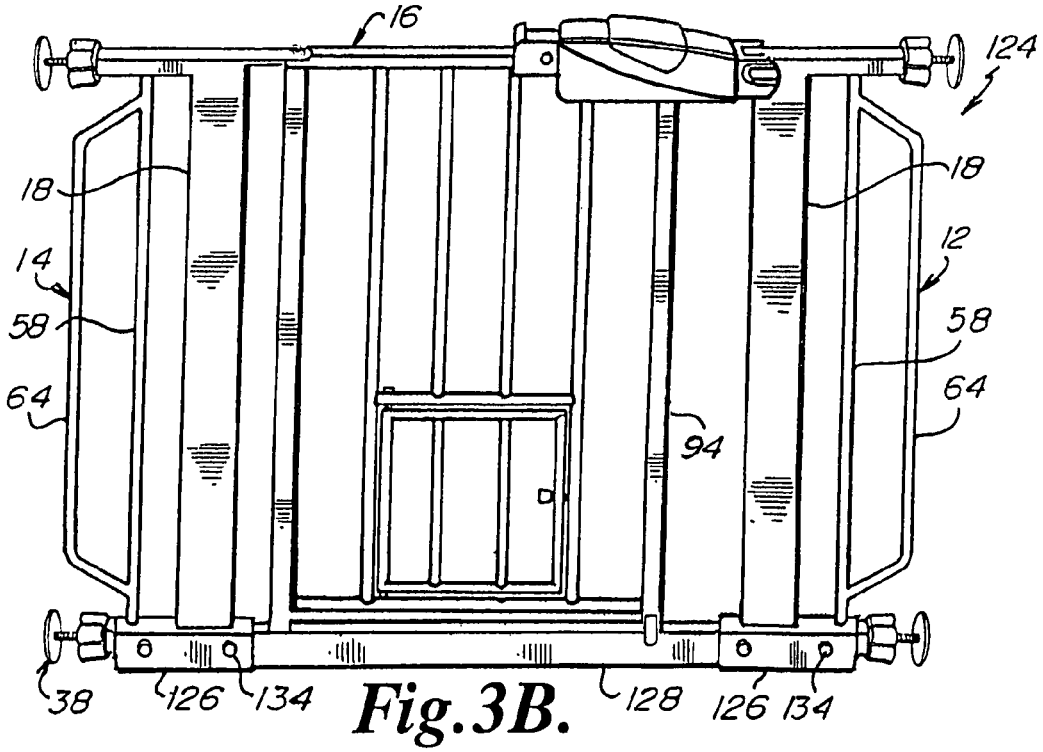
FIG. 3B is a front slightly perspective view of the embodiment of FIG. 3A where the multiple pieces of the barrier have been assembled.
Figure 4:
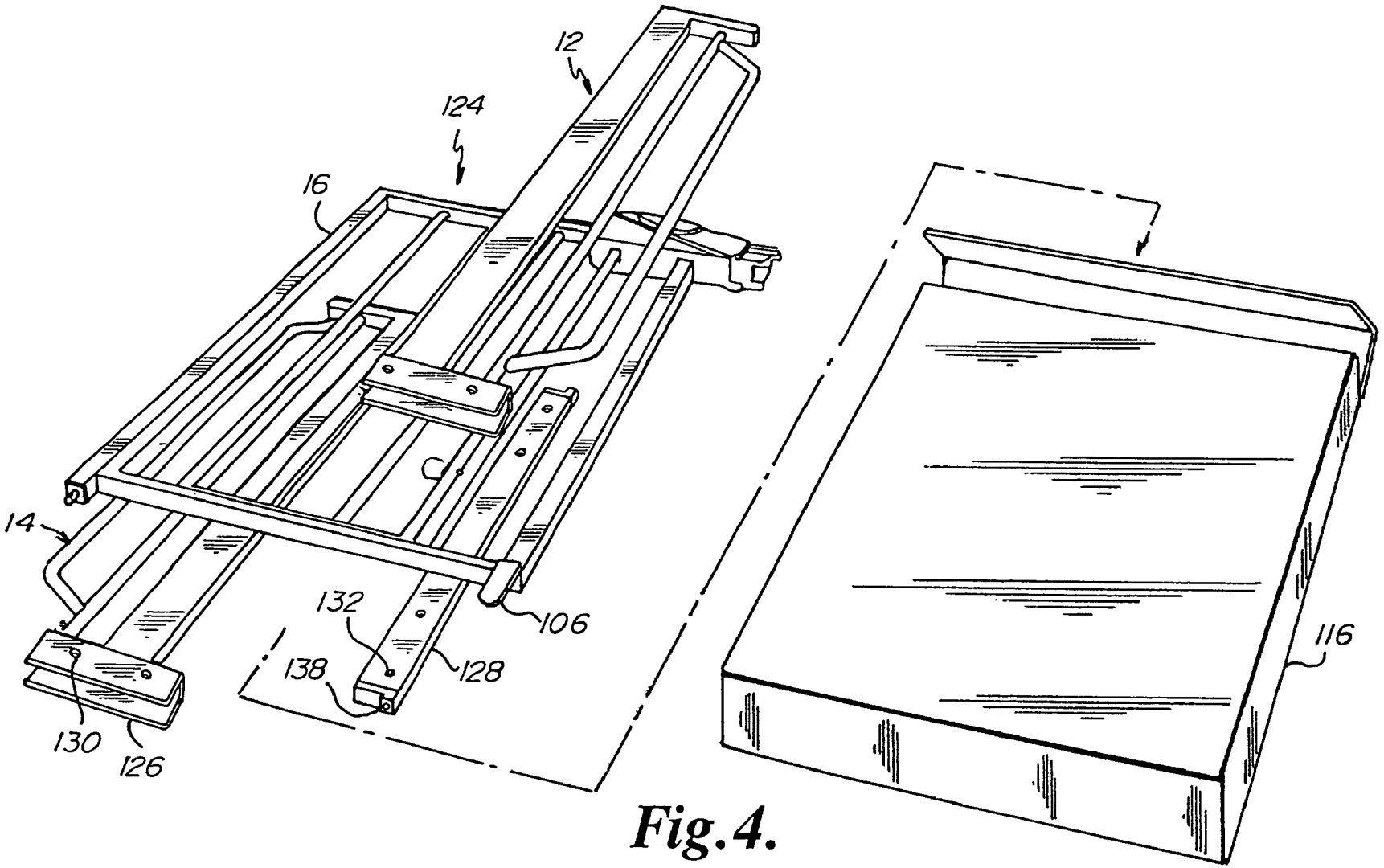
FIG. 4 is a disassembled perspective view of the embodiment of FIGS. 3A and 3B and a carton for receiving and shipping or storing the disassembled embodiment therein.

A multiple piece gated pressurized barrier 124, an alternate embodiment of the invention, is shown in FIGS. 3A, 3B and 4. Barrier 124 is substantially identical to barrier 10 except that 1) lower member 22 is replaced by a lower member 126 on each of the first and second end frames 12, 14, 2) the lower members 126 are engaged with a gate confronting tie or third lower member 128, and 3) mount 68 includes an integral downwardly extending pivot pin to replace pin 70. Lower member 126 is an inverted U-shaped piece that is elongate in the length direction and is preferably formed of a metal such as aluminum or steel. Lower member 126 includes a pair of openings 130 for alignment with a pair of openings 132 formed in gate confronting tie 128. Gate confronting tie 128 is rectangular in section and is preferably formed of a metal such as aluminum or steel. U-shaped lower member 126 fits over and receives therein gate confronting tie 128. Openings 130 may be formed in each of the side sections of the U-shaped lower member 126. Openings 132 may be formed in each of the side sections of gate confronting tie 128. Openings 130, 132 receive threaded pins 134 for engagement of the gate confronting tie 128 to each of the first and second end frames 12, 14. One or more of the openings 130, 132 may have threaded inserts placed therein for reinforcing a connection between pins 134, gate confronting tie 128 and U-shaped lower members 126. Each of the four pins 134 is preferably engaged by each of the side sections of gate confronting tie 128 and by each of the side sections of U-shaped lower member 126. As with lower member 22, lower member 126 includes an inner end portion 136. Inner end portion 136 or a central axis thereof of end frame 12 of barrier 124, forms an oblique angle of slightly more than ninety degrees with standard 18 or a central axis thereof of end frame 12 of barrier 124, such that barrier 124 is also a resiliently pressurized barrier and includes the pressurized configuration and nonpressurized configuration of barrier 10. Standard 18 is integral and one-piece with lower member 126. Lower members 126, along with gate confronting tie 128, are disposed on a common axis in the nonpressurized configuration and are slightly bowed in the pressurized configuration. Each of the outer ends of gate confronting tie 128 includes an opening 138 for reception of the shaft 40 of turnable arm 38. The outer ends of gate confronting tie 128 extend beyond the outer ends of members 126, as shown in FIG. 3B. If desired, gate confronting tie 128 may be slightly lengthened such that the outer ends thereof may extend slightly further beyond outer ends of members 126. In barrier 124, and barrier 10 if desired, pins 134 may be pin connectors where one pin 134 is a male pin that engages in a threading and drawing in manner a female pin such that the openings in the barrier are not threaded and such that the head of the male pin brings pressure to bear upon the barrier from one side and such that the head of the female pin brings pressure to bear upon the barrier from the other side. In barrier 124, eight pins 134 are used to fix the gate confronting tie 128 to the lower members 126, with four male pins engaging four female pins and where openings 130 and 132 are not threaded.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A gated pressurized barrier for being engaged between two locations under pressure, wherein the barrier includes a height direction, a length direction, and a width direction, with the barrier comprising:

a) a first end frame comprising:
   i) an upper member extending generally in the length direction;
   ii) a lower member extending generally in the length direction; and
   iii) a gate confronting standard extending generally in the height direction and being engaged to and between said upper and lower members of said first end frame, with said gate confronting standard having upper and lower ends;

b) a second end frame engaged to the first end frame and comprising:
   i) an upper member extending generally in the length direction;
   ii) a lower member extending generally in the length direction;
   iii) a gate confronting standard extending generally in the height direction and being engaged to and between said upper and lower members of said second end frame, with said gate confronting standard having upper and lower ends;

c) a gate engaged between the end frames, with the gate being pivotally engaged to one of the end frames, with the gate comprising a latch for engaging the other of the end frames;

d) wherein the gate confronting standard of the first end frame is disposed obliquely to the lower member of the first end frame;

e) wherein said lower member of the first end frame includes an inner end, wherein said lower member of the second end frame includes an inner end, and wherein said inner ends of the first and second end frames confront each other;

f) wherein the barrier further includes an inverted U-shaped channel piece integral and one-piece with one of the lower ends of the first and second end frames and wherein the other lower end of the first and second end frames is received in and releaseably pinned to said inverted U-shaped channel piece.

2. The gated pressurized barrier of claim 1, wherein said inverted U-shaped channel piece includes side plate sections spaced apart in the width direction so as to provide a friction fit between said inverted U-shaped channel piece and said other lower end.

3. The gated pressurized barrier of claim 1, wherein said inverted U-shaped channel piece includes an upper plate section having a pair of holes, wherein said other lower end of the first and second end frames includes an upper face and a pair of openings extending downwardly from said upper face, wherein said holes are alignable with said openings, wherein said barrier includes a pair of pins, and wherein said pins engage the holes and openings to releaseably pin said other lower end of the first and second end frames to said inverted U-shaped channel piece.

4. The gated pressurized barrier of claim 1, wherein:

a) the first end frame has two endmost portions, with each of said endmost portions defining a point on a respective parallel axis, with a distance between said parallel axes being a given distance designated as a fourth distance, and where said first end frame is wholly contained within such parallel axes;

b) the second end frame has two endmost portions, with each of said endmost portions defining a point on a respective parallel axis, with a distance between said parallel axes being substantially said fourth distance, and where said second end frame is wholly contained within such parallel axes; and c) the gate has two endmost portions, with each of said endmost portions defining a point on a respective parallel axis, with a distance between said parallel axes being substantially said fourth distance, and where said gate is wholly contained within such parallel axes;

d) such that a storage size of the gated pressurized barrier is minimized.

5. A gated pressurized barrier for being engaged between two locations under pressure, wherein the barrier includes a height direction, a length direction, and a width direction, with the barrier comprising:

a) a first end frame comprising:
   i) an upper member extending generally in the length direction;
   ii) a lower member extending generally in the length direction; and
   iii) a gate confronting standard extending generally in the height direction and being engaged to and between said upper and lower members of said first end frame, with said gate confronting standard having upper and lower ends;

b) a second end frame engaged to the first end frame and comprising:
   i) an upper member extending generally in the length direction;
   ii) a lower member extending generally in the length direction;
   iii) a gate confronting standard extending generally in the height direction and being engaged to and between said upper and lower members of said second end frame, with said gate confronting standard having upper and lower ends;

c) a gate engaged between the end frames, with the gate being pivotally engaged to one of the end frames, with the gate comprising a latch for engaging the other of the end frames;

d) wherein the gate confronting standard of the first end frame is disposed obliquely to the lower member of the first end frame;

e) wherein said lower member of the first end frame is an inverted U-shaped piece and wherein said lower member of the second end frame is an inverted U-shaped piece; and f) wherein the barrier further includes a gate confronting tie tying the end frames together and being releaseably received in each of the inverted U-shaped pieces of the first and second end frames.

6. The gated pressurized barrier of claim 5, wherein said lower member of the first end frame is integral and one-piece with the gate confronting standard of the first end frame and wherein said lower member of the second end frame is integral and one-piece with the gate-confronting standard of the second end frame.

7. The gated pressurized barrier of claim 5, wherein said inverted U-shaped piece of the first end frame includes an outer end, wherein said inverted U-shaped piece of the second end frame includes an outer end, wherein said gate confronting tie includes outer ends, and wherein each of the outer ends of the gate confronting tie extends beyond one of the outer ends of the inverted U-shaped pieces.

8. The gated pressurized barrier of claim 5, wherein said inverted U-shaped pieces are releaseably pinned to the gate confronting tie.

9. The gated pressurized barrier of claim 5, wherein said gate confronting tie includes side sections, wherein each of the U-shaped pieces includes side sections, wherein the barrier includes pins, and wherein said pins engage said side sections of the gate confronting tie and said side sections of the U-shaped pieces.

10. The gated pressurized barrier of claim 5, wherein said gate confronting tie has a length greater than the length of said gate.

* * * * *